United States Patent [19]

Geber

[11] Patent Number: 4,509,977

[45] Date of Patent: Apr. 9, 1985

[54] PROCESS AND DEVICE FOR SCAVENGING A METAL MELT, IN PARTICULAR STEEL, IN A CASTING LADLE OR THE LIKE PROVIDED WITH A PLUG CLOSURE

[75] Inventor: Hans Geber, Unkel, Fed. Rep. of Germany

[73] Assignee: Messer Griesheim GmbH, Frankfurt am Main, Fed. Rep. of Germany

[21] Appl. No.: 592,219

[22] Filed: Mar. 22, 1984

[30] Foreign Application Priority Data

Mar. 30, 1983 [DE] Fed. Rep. of Germany ..... 3311617

[51] Int. Cl.[3] ..... C21C 7/00

[52] U.S. Cl. ..... 75/59; 75/58; 266/265; 266/275

[58] Field of Search ..... 75/59, 60, 58; 266/265, 266/275

[56] References Cited

U.S. PATENT DOCUMENTS

| | | | |
|---|---|---|---|
| 3,574,596 | 4/1971 | Lohman | 75/59 |
| 3,664,652 | 5/1972 | Spire | 75/59 |
| 4,026,698 | 5/1977 | Koump | 75/59 |

*Primary Examiner*—Peter D. Rosenberg
*Attorney, Agent, or Firm*—Connolly and Hutz

[57] ABSTRACT

The process is directed to scavenging a metal melt, particularly steel, in a casting ladle or the like wherein a plug closes an outlet from the inside at the bottom of the ladle whereby a scavenging gas, such as argon, is introduced into the melting bath through the bottom of the ladle. The process is characterized by introducing the scavenging gas through the outlet when the plug is in its closing position.

18 Claims, 2 Drawing Figures

PROCESS AND DEVICE FOR SCAVENGING A METAL MELT, IN PARTICULAR STEEL, IN A CASTING LADLE OR THE LIKE PROVIDED WITH A PLUG CLOSURE

BACKGROUND OF INVENTION

The invention relates to a process and a device for scavenging a metal melt, in particular of steel, in a casting ladle or the like, which has an outlet at the bottom having a plug closing from the inside of the ladle whereby the scavenging gas, for example, argon is introduced through the bottom of the ladle in the melting bath.

It is known to scavenge metal melts by means of a gas introduced in the melting bath to purify or homogenize the bath and to bring the bath up to the most possible uniform temperature. In steel production, argon is mostly used as a scavenging gas which is introduced in the casting ladle, preferably, through the bottom of the ladle. The known casting ladles have a scavenging gas supply line at the bottom of the ladle for this purpose in addition to their outlet which can, for example, be closed by a plug arranged on a plug rod. This supply line consists of a porous sheet metal-clad conical gas scavenging stone which is inserted in a perforated fire brick arranged at the bottom of the ladle by using a joint kit and is exchangeably held by means of a bayonet lock. The scavenging stone has a threaded pipe for connecting the scavenging gas line.

The installation of scavenging stones of the above-mentioned type involves considerable expense. In use, the scavenging stone is exposed to a high degree of wear and must, therefore, be exchanged after a certain number of castings. The premature wear of the scavenging stone often leads to a undesired reduced service life of the ladle. The scavenging stone inevitably creates a hazard for steel run-out. When in one operation, only part of the melt is subjected to gas scavenging, which is often the case. In practice, casting ladles must be used side by side with built-in and without scavenging devices. When not in use, the casting ladles equipped with the scavenging device must be either kept hot or be heated again before use to the desired temperature.

Conventional scavenging methods of the known type often lead to breakdowns and waiting periods caused by melt deposits on the more or less exhausted scavenging stones. Only when these deposits, so-called bears, are melted again, the argon can arrive through the scavenging stone in the melting bath. When the deposits do not melt, which occasionally is the case, scavenging of the melt in the casting ladle cannot be accomplished.

SUMMARY OF INVENTION

It is an object of the invention to provide an economical scavenging process and a simple scavenging device which can be used to reliably conduct gas scavenging with supply of the scavenging gas through the bottom of the ladle without the need for scavenging systems with porous scavenging stones or other expensive and problem-creating scavenging devices used in conventional casting ladles with plug closing.

This object is met with the process according to the invention by introducing the scavenging gas with the plug in closing position through the outlet.

It was surprisingly found that in conventional casting ladles having the outlet located at the bottom of the ladle which can be closed off by a plug arranged on a plug rod, the scavenging gas can be readily introduced from below through the outlet in the bath when the plug is found in its closing position in which it closes off the outlet in relation to the melting bath. The usual closing plug, to be sure, is liquid-tight but not gas-tight so that it allows the introduction of the scavenging gas but at the same time effectively closes the outlet to discharging of the melt. It is, moreover, possible with the process according to the invention to operate with the usual scavenging gas pressures which at the scavenging start, for example, are about 0.5 bar and increase to about 3 bar with rising melting bath level in the ladle. The scavenging process according to the invention operates reliably, especially since the outlet stone and the plug arranged on the plug rod must be renewed anyway after each casting whether scavenging takes place or not.

It is, therefore, possible with the process according to the invention to use the usual casting ladles with plug closing selectively for the scavenging gas operation as well as without scavenging gas supply. Conventional scavenging gas systems are omitted so that also their disadvantages are avoided. The usual casting ladles can be used without changes for the scavenging gas operation. It is only necessary to introduce the scavenging gas supply in the outlet stone present in the bottom of the ladle and to seal it towards the supply side in the outlet. In the scavenging procedure, the scavenging gas (argon) rises in the bath in the peripheral area of the plug rod and produces there the so-called scavenging dome with the plug rod in the center. As a result, the slag is kept away from the fire-proof material of the plug rod so that exhaustion cannot occur here either. After scavenging, the scavenging device is removed again from the outlet. It can be used over and over again.

An especially simple and expedient process can be attained when for the scavenging procedure a scavenging lance is introduced together with a peripheral seal from below the casting channel of the outlet stone arranged at the bottom of the ladle and is sealed inside the casting channel by means of a peripheral seal. The peripheral seal can at the same time fix the scavenging lance in the casting channel of the outlet stone so that additional connecting or holding devices are not required. After the scavenging procedure is completed, the scavenging lance with the peripheral seal is pulled again from the casting channel of the outlet stone. When connecting the scavenging lance, it is recommended to introduce the lance up to the vicinity of the plug resting on the seating surface of the outlet stone or up to its stop in the casting channel of the outlet stone; sealing of the casting channel then effectively takes place near the inside end of the scavenging lance having the scavenging gas outlet.

In order to conduct the process according to the invention with particular advantage, a scavenging lance is used which can be introduced in the casting channel of the outlet stone arranged at the bottom of the ladle, which lance is provided with a peripheral seal sealing the casting channel of the outlet stone appropriately located near the end of the scavenging lance having the scavenging gas outlet and preferably consists of an elastic material, for example, especially rubber or the like. Particularly advantageous is an arrangement in which a sealing sleeve or the like enclosing the scavenging lance is used for the peripheral seal, which can be radially deformed by a compression effect so that the scavenging lance is mounted in the outlet stone and at the same time sealing to the outside is achieved. The sealing sleeve or the like expediently rests against a fixed stop of the scavenging lance; it is compressed resp. radially deformed by means of a compression element movable in longitudinal direction of the scavenging lance which preferably consists of a push-out tube enclosing the tube-shaped scavenging lance. It is recommended to implement the arrangement in such a way that the scavenging lance has a threaded section at its end projecting from the casting channel of the outlet stone with which a manually actuated tensioning element is in contact via the threads used for the adjustment of the push-out tube to produce or release the peripheral seal in the longitudinal direction of the scavenging lance.

In the scavenging device according to the invention, the only wear component is the above-mentioned seal which, as could be established, can be used for at least about 30 scavenging procedures. This seal is an inexpensive replacement part.

THE DRAWINGS

FIG. 1 shows a vertical cross section of a conventional casting ladle with an outlet and with a scavenging device according to the invention; and FIG. 2 shows a vertical cross section and on a larger scale of the outlet of the casting ladle together with the scavenging device according to the invention.

DETAILED DESCRIPTION

Figure 1:
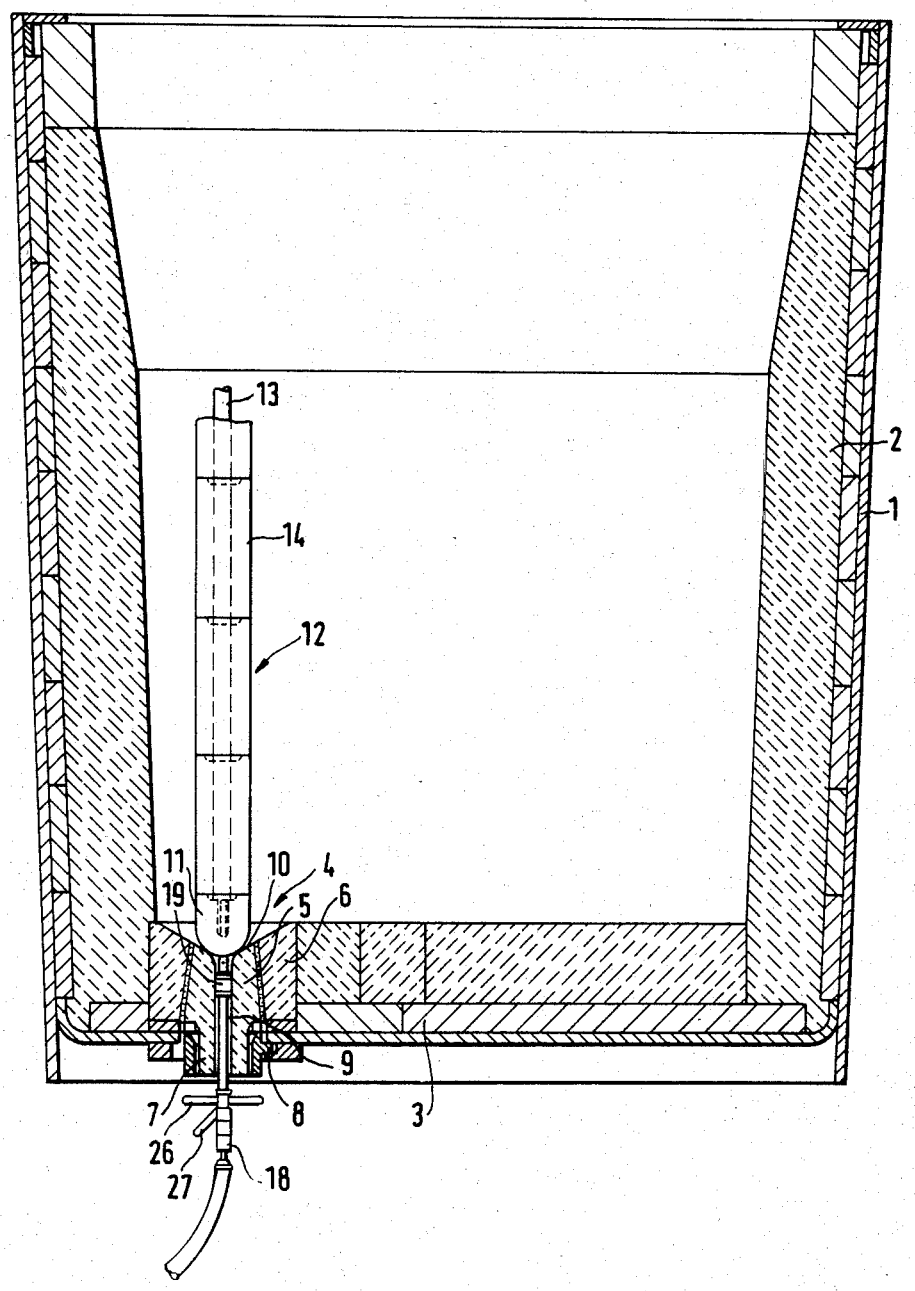

The casting ladle 1 with fire-proof lining 2 shown in the drawing is of the conventional type. At the bottom of the ladle 3 an outlet 4 is found with a plug closing. The outlet 4 consists of an outlet stone 5 made of fire-proof material which rests in a perforated stone 6 having a conical inside opening. The perforated stone 6 also consists of fire-proof material; it is located in the fire-proof brickwork of the bottom of the ladle. The outlet stone 5 has a neck piece 7 offset in diameter which passes through an opening at the bottom of the ladle 3. Securing of the outlet stone 5 takes place by means of a holding device 8 with bayonet lock or the like.

The outlet stone 5 has a continuous vertical casting channel 9 which at the inside of the ladle ends in a flat-conical recess of the top surface of the outlet stone 5 which forms the seating surface for a plug 11 made of fire-proof material sealing the outlet. The plug 11 is fastened at the bottom end of a plug rod 12 which consists of a steel rod 13 provided with a fire-proof jacket 14. The plug rod 13 projects at the top from the casting ladle 1 and is connected here in a known manner with a lever bar (not shown) by means of which the plug rod 12 can be lifted for opening the outlet and lowered for closing the outlet with the plug 11 to the seating surface 10 of the outlet stone 5.

The above described embodiment of the casting ladle 1 and its outlet 4 with the plug rod 12 is of the conventional type and, therefore, needs no further explanation.

Figure 2:
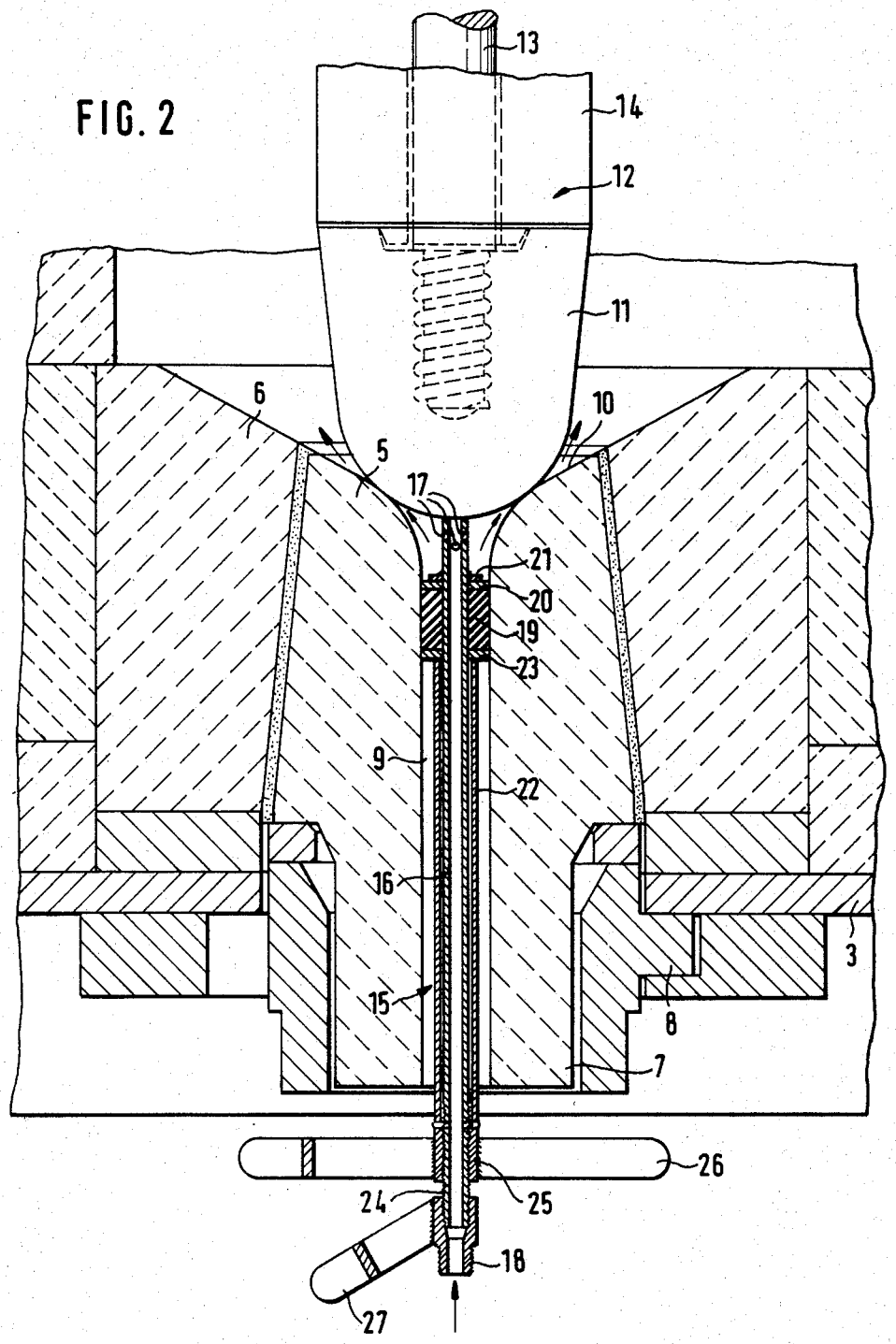

In order to scavenge the melt, located in the casting ladle 1, for example, steel with a gas, in particular, argon, a scavenging device 15 is introduced from below in the casting channel 9 of the outlet stone 5. As can be seen, in particular, in FIG. 2 the scavenging device 15 consists of a tubular scavenging lance 16 having a length slightly greater than the length of the casting channel 9 of the outlet stone 5. The scavenging lance 16 has several cross bores 17 near its one end for the discharge of scavenging gas. At the other end, it is provided with a connecting fitting 18 to which a scavenging gas supply line, for example, a hose can be connected by means of a rapid disconnect coupling. The scavenging lance 16 has a peripheral seal near the bores 17 in the form of a sealing sleeve 19 made of elastic material such as rubber or the like which via a support ring 20 rests against a stop 21 in the form of a collar mounted permanently on the scavenging lance. The sealing sleeve 19 encloses the tubular scavenging lance 16; it is radially deformable by means of a compression element in the form of a push-out tube 22 which is movable in longitudinal direction of the scavenging lance 16. The push-out tube 22 acts on the sealing sleeve 19 via an annular pressure disc 23. The scavenging lance 16 has a threaded section 24 at its end projecting from the casting channel 9 with which a nut 25 is in threaded contact and is provided with a handle or hand wheel 26. By turning the nut 25, the push-out tube 22 can be adjusted in longitudinal direction in relation to the tubular scavenging lance 16. At the outside end of the scavenging lance, for example, on the connecting fitting 18, a handle 27 is fastened.

In order to conduct scavenging, the above described scavenging device 15 is introduced from below in the casting channel 9 of the outlet stone 5 until the scavenging lance 16 stops against the plug 11. The bores 17 are then located immediately below the plug 11 which rests on the seating surface 10 of the outlet stone 5 with approximate line contact and closes the casting channel 9 against discharge of the melt. The peripheral seal formed by the sealing sleeve 19 is also found near the inside end of the casting channel 9, in other words, at a small distance below the bores 17 in the scavenging lance 16. By rotating the hand wheel 26 or the like, the push-out tube 22 is adjusted in the direction of the sealing sleeve 19 in relation to the scavenging lance 16. The scavenging lance 16 is held against rotation at the handle 27. When shifting the push-out tube 22, the elastic sealing sleeve 19 is compressed whereby it is radially deformed and is pressed against the inside wall of the casting channel 9. In this way, the entire scavenging device 15 is fixed in the scavenging position in the outlet stone 5 shown in FIG. 2 and at the same time the casting channel 9 of the outlet stone 5 is sealed off so that scavenging gas cannot escape to the outside through the casting channel. The scavenging gas supply line is connected to the fitting 18 by means of the rapid disconnect coupling. When opening a valve, therefore, the scavenging gas flows through the tubular scavenging lance 16 to the plug 11. The scavenging gas emerges via the radial bores 17 directly under the plug 11 in the exit area of the casting channel 9 and then flows in the direction of the arrows past the plug 11 found in the sealing position in the casting ladle 1. It was shown that the conventional plug seals reliably seal the outlet of the casting ladle in relation to the metal melt, to be sure, but that they are not gas-tight so that the scavenging gas can flow past the plug 11 found in the sealing position and enter the melting bath without having to operate at gas pressures which exceed the usual gas pressures when using porous scavenging stones. During the scavenging procedure, the scavenging procedure, the scavenging device 15 is held in its position by the sealing sleeve 19 expanded firmly against the inside wall of the casting channel 9. It is advantageous for conducting the scavenging procedure when the peripheral seal formed by the sealing sleeve 19 is located as close as possible to the end of the scavenging lance 16 located on the inside.

After conducting the scavenging procedure, the expansion of the sealing sleeve 19 is released by rotating the hand wheel or the handle 26 in opposite direction. The entire scavenging device 15 can then be pulled down from the casting channel 9 of the outlet stone 5.

The above described scavenging device 15 can be used with all usual casting ladles which have an outlet at the bottom which is closed off from the inside of the casting ladle by a plug 11 made of fire-proof material. In order to conduct gas scavenging, therefore, special devices do not have to be provided on the casting ladles. It is obvious that the scavenging device according to the invention can be used for all melting vessels and the like with a bottom outlet and plug closing.

What is claimed is:

1. In a process for scavenging a metal melt especially of steel in a casting ladle or the like, which has an outlet at the bottom with a plug closing from the inside of the ladle whereby the scavenging gas is introduced in the melting bath through the bottom of the ladle, the improvement being in that the scavenging gas is introduced through the outlet with the plug in its closing position.

2. Process according to claim 1, characterized in that a scavenging lance together with a peripheral seal is introduced from below in the casting channel of the outlet stone arranged at the bottom of the ladle for conducting the scavenging procedure and is sealed inside the casting channel by means of the peripheral seal and in that upon completion of the scavenging procedure, the scavenging lance with the peripheral seal is pulled from the casting channel of the outlet stone.

3. Process according to claim 2, characterized in that the scavenging lance is introduced up to the vicinity of the plug resting at the seating surface of the outlet stone and its stop in the casting channel of the outlet stone and is sealed by means of the peripheral seal near its end in the casting channel having the scavenging gas discharge.

4. In a device for scavenging a metal melt in a casting ladle or the like which has an outlet at the bottom thereof with a plug closing from the inside of said ladle whereby the scavenging gas is introduced in the melting bath through said bottom of said ladle, the improvement being means for introducing said scavenging gas through said outlet while said plug is in its closing position, said means comprising a scavenging lance which can be introduced in the casting channel of the outlet stone at said bottom of said ladle which is provided with a peripheral seal sealing said casting channel of said outlet stone.

5. Device according to claim 4, characterized in that said peripheral seal is arranged near the end of said scavenging lance having the scavenging gas discharge.

6. Device according to claim 5, characterized in that said peripheral seal consists of an elastic material.

7. Device according to claim 6, characterized in that said peripheral seal consists of a sealing sleeve which encloses said scavenging lance and is radially deformable by compression.

8. Device according to claim 7, characterized in that said sealing sleeve rests against a fixed stop of said scavenging lance and is radially deformable by means of a compression element movable in longitudinal direction of said scavenging lance.

9. Device according to claim 8, characterized in that said compression element consists of a push-out tube enclosing said tubular scavenging lance.

10. Device according to claim 9, characterized in that said scavenging lance has a threaded section at its end projecting from said casting channel with which a manually actuated tensioning element is in threaded contact and is used to adjust said push-out tube in longitudinal direction of said scavenging lance for producing and releasing said peripheral seal.

11. Device according to claim 10, characterized in that a handle is fastened to the outside end of said scavenging lance having a scavenging gas fitting.

12. Device according to claim 6, characterized in that said peripheral seal is made of rubber.

13. Device according to claim 4, characterized in that said peripheral seal consists of an elastic material.

14. Device according to claim 13, characterized in that said peripheral seal consists of a sealing sleeve which encloses said scavenging lance and is radially deformable by compression.

15. Device according to claim 14, characterized in that said sealing sleeve rests against a fixed stop of said scavenging lance and is radially deformable by means of a compression element movable in longitudinal direction of said scavenging lance.

16. Device according to claim 15, characterized in that said compression element consists of a push-out tube enclosing said tubular scavenging lance.

17. Device according to claim 16, characterized in that said scavenging lance has a threaded section at its end projecting from said casting channel with which a manually actuated tensioning element is in threaded contact and is used to adjust said push-out tube in longitudinal direction of said scavenging lance for producing and releasing said peripheral seal.

18. Device according to claim 17, characterized in that a handle is fastened to the outside end of said scavenging lance having a scavenging gas fitting.

* * * * *